United States Patent [19]

Meuresch et al.

[11] 4,015,752

[45] Apr. 5, 1977

[54] RAPID CHARGING VALVE FOR A PRESSURIZED DISPENSER

[75] Inventors: Herbert Meuresch, Wiesbaden; Tilo Patenge, Hattersheim, both of Germany

[73] Assignee: Precision Valve Corporation, Yonkers, N.Y.

[22] Filed: Jan. 27, 1976

[21] Appl. No.: 652,729

[30] Foreign Application Priority Data

Jan. 29, 1975 Germany ..... 2503626

[52] U.S. Cl. ..... 222/402.16; 222/402.21

[51] Int. Cl.[2] ..... B65D 83/14

[58] Field of Search ..... 222/402.24, 402.16, 222/402.17, 402.18, 402.19, 402.2, 402.21, 402.22, 402.23, 402.25

[56] References Cited

UNITED STATES PATENTS

| | | | |
|---|---|---|---|
| 3,180,374 | 4/1965 | Muller | 222/402.16 X |
| 3,845,887 | 11/1974 | Meuresch et al. | 222/402.16 |

*Primary Examiner*—Stanley H. Tollberg
*Attorney, Agent, or Firm*—Davis, Hoxie, Faithfull & Hapgood

[57] ABSTRACT

A valve for a pressurized dispenser which includes within a mounting cup, a valve housing and an annular gasket for sealing a discharge passage of a movable valve stem, the gasket having peripheral edge portions which do not extend to contact the valve cup surrounding wall, and a marginal portion between its peripheral edge and the portion clamped between the mounting cup and the valve housing, and which incorporates a clearance space within the cup and beyond the periphery of the gasket to accommodate the marginal portion of the gasket when stretched during the filling of the dispenser so that a flow path is provided to the outside of the housing. The gasket is preferably polygonal in shape, for example hexagonal.

7 Claims, 3 Drawing Figures

RAPID CHARGING VALVE FOR A PRESSURIZED DISPENSER

Figure 1:
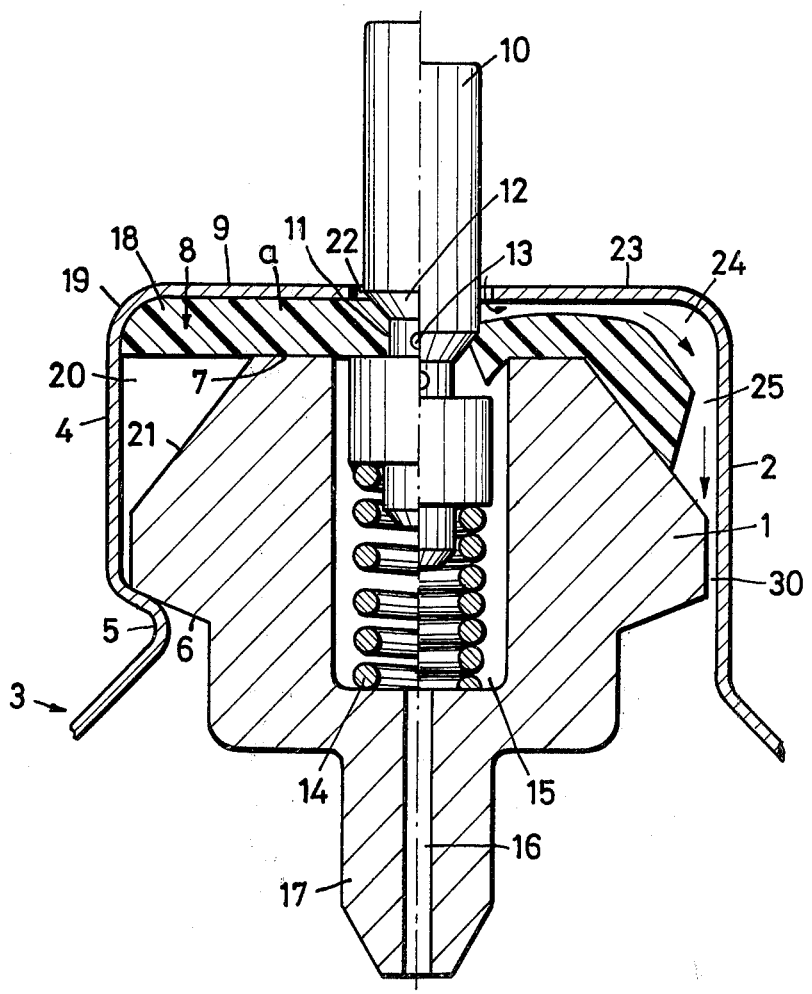

The invention relates to a valve for pressurized aerosol dispensers, the valve having an annular gasket provided with a hole for receiving, a valve stem and pressed by a clamping edge on the valve housing against the end wall of the pedestal of a valve mounting cup immovably holding the valve housing, and wherein at least one filling aperture is provided in the end wall around the valve stem hole, filling passages extend near the circumferential wall of the valve mounting cup, and the gasket is adapted to be forced away from the end wall of the valve mounting cup under the influence of the pressure of propellant gas during charging.

U.S. Pat. No. 3,845,887 to Meuresch et al. shows a gasket with a polygonal periphery wherein the circumferential sections having the shortest radial distance from the center extend outwardly beyond the clamping edge by an amount such that, when the portion of the gasket under the filling aperture is bent downwardly under the influence of the filling pressure, the portion of the gasket clamped by the housing rim will be stretched away from the end wall and accordingly will provide additional filling passages outside the valve housing. In this way the filling speed may be substantially increased.

U.S. Pat. Nos. 3,838,799 to Meuresch et al., 2,890,817 to Rheinstrom, and 2,937,791 to Micallef show valves in which the gasket extends beyond the clamping edge above an annular space defined partly by sloping shoulders of the housing and partly by the circumferential wall of the valve mounting cup. In the end wall of the valve mounting cup there are provided additional filling apertures radially outward of the clamped region of the gasket. The gasket margin below these filling apertures will be directly influenced by the filling pressure and will be bent downwardly, thereby opening additional filling passages outside the valve housing. In these constructions, however, the margin of the gasket is sealed against the filling apertures only by the internal pressure of the container.

Other known structures for providing for filling outside the valve housing over the gasket by displacing the gasket axially are shown in Treharne, Jr. U.S. Pat. No. 3,441,177, Ferry, Jr. et al. U.S. Pat. No. 3,158,297, and Briechle U.S. Pat. No. 3,158,298. Ferry, Jr. and Micallef also show structures in which the valve housing is axially displaced by filling pressure to unclamp the gasket. British patent specification No. 1,362,885 shows a structure in which the gasket is axially raised to allow gas ducted through the valve stem to pass the clamped region and flow outside the valve housing.

The present invention provides a dispenser valve which during filling permits a greater proportion of the fluid to flow outside the valve housing thereby permitting faster and more reliable filling than filling exclusively through the valve, while providing a tight seal after filling.

In accordance with the present invention, this goal is achieved by providing an annular clearance space radially outward of the valve housing rim which clamps the gasket, which clearance space accommodates the marginal portion of the gasket between the clamped portion and the peripheral edge of the gasket as the gasket is radially stretched and deflected under the influence of filling pressure.

In this construction the clearance space ensures that the gasket margin may be freely expanded. Accordingly, the gasket is more easily compressed in thickness in the clamped region to provide a passage for filling fluid to pass by the clamped region. The gasket returns to its initial position, shape and thickness when filling pressure is terminated, the elastic restoring forces of the gasket providing a tight seal at the clamped portion. Consequently, the filling pressure will compress the gasket in the clamped region to open a filling passage over the clamped region. The fluid flowing outwardly over the gasket also tends to radially stretch or expand the gasket thereby assisting in thinning the gasket in the clamped region. Since the filling aperture is radially interior of the clamped region, a tight seal after filling is insured.

It is of particular advantage that the margin of the gasket extends radially outward beyond the clamping rim of the valve housing and that the annular clearance space extends axially of the valve. In this manner the dimensions of the valve can be kept small and standard size valve parts and valve mounting cups can be used thereby requiring little or no change in assembling and filling machinery.

It is desirable to provide an axially directed clearance space having a surface extending at a sharp angle from the outer edge of the clamping rim against which the margin of the gasket is pressed by the filling fluid to thereby achieve a sharp bend of the gasket which assists in thinning the gasket because of the additional stretching of the upper surface of the gasket occasioned by bending. Preferably the abutment surface is cylindrical to provide a right angle at the clamping rim although the surface may also be in the form of a steep cone. Furthermore, the clearance space may be made as long as desired without increasing the diameter of the valve.

It is advantageous that the clearance space for receiving the gasket margin during filling have a radial dimension of at least 40% of the initial thickness of the uncompressed gasket. Most preferably, the radial dimension should be greater than 90% of the thickness of the uncompressed gasket to maximize the cross section of the flow passages for very rapid filling.

It is desirable that the axial dimension of the clearance space below the clamping rim of the housing be at least 110%, preferably more than 125% of the radial dimension of the marginal portion of the gasket to accommodate the increase in radial dimension of the gasket caused by stretching during filling. The smaller dimension is appropriate for harder gasket materials and the greater dimension is appropriate for softer materials.

Portions of the gasket peripheral edge in the normal condition prior or subsequent to filling should extend to contact the inner surface of the surrounding circumferential wall of the valve mounting cup pedestal or other surrounding structure. This assists in maintaining the gasket centered with respect to the valve axis. Those portions of the gasket need not actually contact the circumferential wall if the circumferential and end walls of the pedestal are joined by a radius at least 0.8 mm and preferably 1.3 mm in which case the portions of the gasket perimeter contact the inner surface of the radius. The radius also has the effect that as soon as the gasket begins to radially expand during filling, it will be deflected downwardly by the radius, thereby making easier its displacement into the annular clearance space.

Only portions of the peripheral edge of the gasket should contact the surrounding wall surface, which surface may be the circumferential wall of the valve mounting cup pedestal. Thus, the gasket may be polygonal, preferably hexagonal. This form of gasket provides a marginal portion easily bent into the clearance space and insures against blockage of the filling fluid path because those portions of the peripheral edge which are of lesser radial extent are spaced from the surrounding wall surface during filling. A similar effect may be achieved by the use of circular gasket having radial incuts.

Extremely short fill times in the order of only 1.5 seconds will be achieved and great reliability of filling ease and sealing integrity accomplished if the clamping rim of the housing is the end face of a cylindrical tube such that both surfaces of the housing adjacent the clamping rim are cylindrical abutment surfaces against which the marginal portion and the portion of the gasket inward of the clamped region are pressed during filling. The reason is that the gasket is sharply bent on either side of the clamped portion to maximize thinning and radial forces due to rapid fluid flow are balanced to reduce any tendency of the gasket to laterally shift with respect to the valve housing.

The invention will now be explained with reference to the accompanying drawings representing preferred embodiments by way of example.

Figure 2:
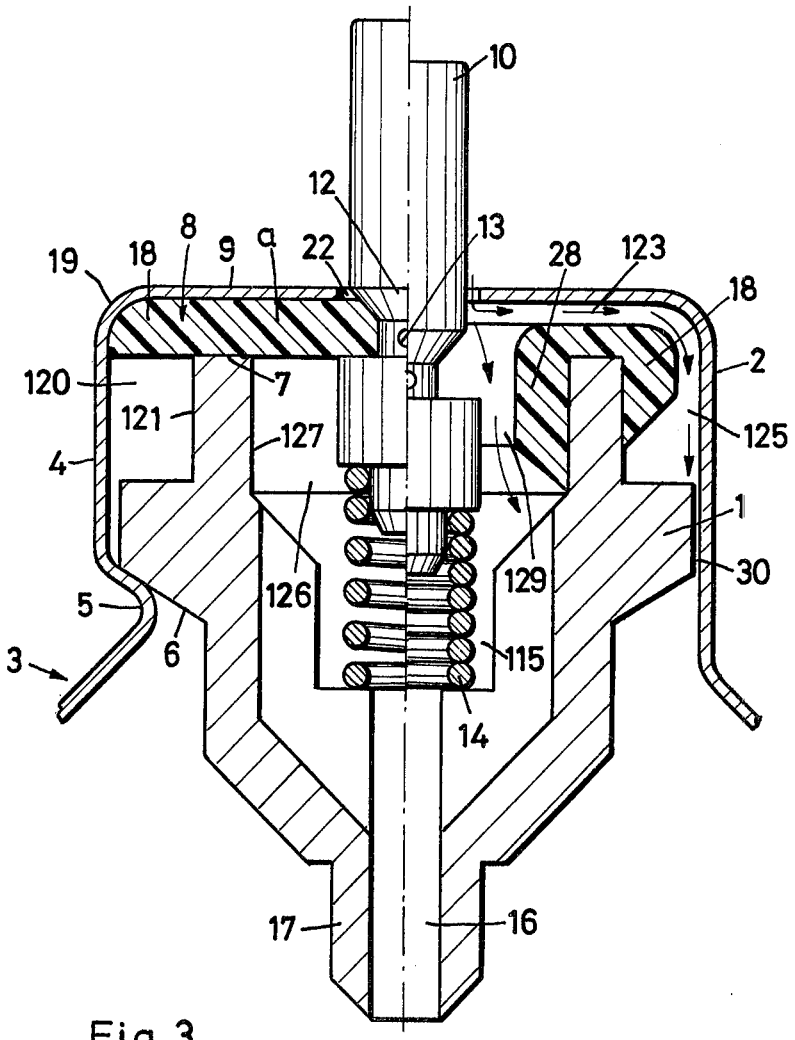
Figure 3:
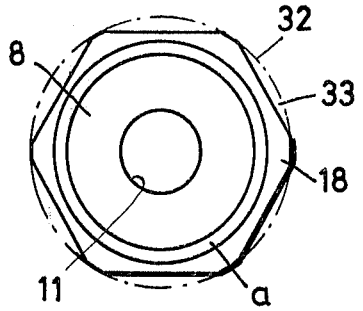

In the drawings:

FIG. 1 shows a longitudinal cross section of a valve in accordance with the invention, the left half of the figure showing the valve in its normal closed position and the right half of the figure showing the valve in its position during filling, FIG. 2 shows a longitudinal cross section, in accordance with FIG. 1, of a further embodiment, and FIG. 3 shows a plan view of a hexagonal sealing gasket.

Referring now to FIG. 1, a valve housing 1 is fixedly held in a valve mounting cup pedestal 3 having a circumferential wall 4 and an end wall 9. The valve mounting cup constitutes a closure member which is sealed to the mouth of the container. The housing 1 is affixed in the pedestal by circumferentially spaced crimps 5 engaging the underside of a flange 6 of the valve housing. A clamping rim 7 of the housing presses axially against a gasket 8, clamping region *a* of the gasket against end wall 9 of the pedestal of the valve mounting cup.

A moveable valve body having a hollow valve stem 10 passes through central aperture 11 in the gasket 8. The inner edge of the aperture 11 engages a neck portion 12 to block valve orifice 13 communicating with the hollow interior of the valve stem 10 upon which a button having a spray nozzle is usually placed. The valve body is biased upwardly by a spring 14 located in the interior chamber 15 of the valve housing 1. A restricted area passage 16 extends to a nipple 17 for receiving an eduction or dip tube. When the valve stem 10 is depressed the gasket 8 is deflected out of blocking engagement with valve orifice 13 to establish a passage for product from the container through the hollow valve stem 10.

The gasket has a peripheral edge having portions which extend radially further than other portions. FIG. 4 shows a polygonal, specifically hexagonal, gasket suitable for the embodiments of FIGS. 1 and 2. The further extending peripheral edge portions of the marginal portion 18 of the gasket outward of the clamping rim 7 extend substantially to the circumferential wall 4 and engage the radius 19 joining wall 4 and end wall 9. Axially below the margin 18 is an annular clearance space 20 bounded by a conical abutment surface 21 sharply angled with respect to clamping edge 7. Between the circumferential wall 4 of the pedestal and the periphery of the valve housing 1 is a gap 30 which communicates the container interior with the clearance space 20. A central aperture 22 in the end wall 9 is larger in diameter than valve stem 10 to provide a filling aperture outside the valve stem 10 and radially interior of the clamped region *a* of the gasket.

During filling, fluid flows into the container not only through the valve stem and open valve port 13, but also through filling aperture 22. Filling pressures of 40 to 120 bar, for example, compress the gasket 8 in clamped region *a* to provide a flow path over the gasket. Accordingly, the material of the gasket will, because of this compression, be displaced outwardly. A compression of 10% in thickness will lead to an increase in diameter of the same percentage. This radial expansion of the gasket is accommodated by the clearance space 20. At the same time the gasket 8 is bent downwardly and is pressed against abutment surface 21. This downward bending of the gasket is assisted by the guiding action of radius 19 as the gasket begins to expand and is furthered by the high pressure and high velocity of fluid flow over the gasket. The clearance space 20 is dimensioned such that after bending and radial expansion a gap 25 remains between the peripheral edge of the gasket and the circumferential wall. This gap is greatest in the middle of the flat sides of a polygonal gasket where the periphery has the least radial extent. Consequently, the filling fluid flows, as indicated by the arrows on the right of FIG. 1, through a relatively open path into the container. As soon as filling is terminated, the gasket 8 returns, due to its elasticity, into the initial position shown on the left side of FIG. 1. The internal pressure of the now filled container further assists in restoring the gasket to its sealed condition by pressing the gasket upwardly and to produce, using radius 19, a force component directed inwardly.

Referring to FIG. 2, the same numerals are used for identical parts as in FIG. 1, whereas for similar parts reference numerals augmented by 100 are used. The main difference is that the annular clearance space 120 is in the form of a rectangular groove or rabbet and has a cylindrical abutment surface 121 extending perpendicular to the clamping rim 7. Furthermore, the interior chamber 115 of the valve housing 1 has an enlarged diameter portion 126 when compared with chamber 15 of FIG. 1. Portion 126 has a cylindrical abutment surface 127 for the portion of the gasket interior of the clamped portion *a*.

During filling the polygonal gasket 8 will occupy the position represented in the right side of FIG. 2. The inner marginal portion 28 interior of the clamping rim 7 will be bent downwardly at a right angle by filling pressure and pressed against the abutment surface 127. The outer marginal portion 18 is accommodated in the clearance space 120 and is also bent downwardly at a right angle. The effect of these double sharp bends is to stretch considerably the upper surface of the gasket, and accordingly, the gasket is substantially thinned in the clamped region *a*, thereby providing a large area gap 123 between the gasket and the end wall 9. Also the gap 125 between the sealing disc margin 18 and the surrounding wall will be of substantial area. In addition to the filling flow path outside the housing there exists a filling flow path from aperture 22 interior of the housing and exterior of the stem as well as the flow path through the valve stem 10 and opened orifice 13. This configuration provides extremely rapid and reliable filling and resealing.

The valve of the present invention is particularly useful for dispensers charged with $CO_2$ or other compressed gas. Valves not having a filling flow path outside the valve housing must be charged through the housing and pressures and filling rates must be kept relatively low to avoid bursting the housing. By proportioning flow inside and outside the housing, much higher pressures and flow rates can be employed. High pressure, high flow rate filling using a conventional housing with a circular gasket results in very few successfully filled dispensers. Use of the hexagonal gasket and conventional housing shown in Meuresch et al. U.S. Pat. No. 3,845,887 produces a sharp improvement, but still result in some failures. The embodiments of the present invention can be successfully charged with high pressure, high flow rates with virtually no failures.

What is claimed is:

1. In a valve for a pressurized dispenser, said valve having a mounting cup, a valve housing immovable relative thereto and a gasket for sealing a discharge passage, the gasket being clamped between a rim of said housing and an adjacent wall of the mounting cup, said mounting cap having a pedestal portion comprising an end wall and a circumferential wall and a filling aperture in the end wall radially outward of the discharge passage and only inward of the clamping rim, the improvement which comprises said gasket having an annular clamped region, a peripheral edge having portions which extend to contact a surrounding wall separated by other portions which do not contact the surrounding wall, and a marginal portion between the peripheral edge and the clamped region, and a clearance space below the marginal portion of the gasket to accommodate the marginal portion so that the marginal portion may radially stretch and deflect during filling to provide a flow passage along the adjacent wall surfaces over the gasket, past the clamped region and around the peripheral edge of the gasket.

2. The improvement of claim 1 wherein the clearance space is provided by a conical surface of the valve housing located radially outward of the clamping rim.

3. The improvement of claim 1 wherein the clearance space is provided by a circumferential rabbet in the housing located radially outward of the clamping rim.

4. The improvement of claim 1 wherein the periphery of the gasket is polygonal.

5. The improvement of claim 1 wherein the clearance space has a radial dimension at least 40% of the thickness of the gasket when uncompressed and an axial dimension below the clamping rim of at least 110% of the greatest radial extent of the marginal portion of the gasket.

6. The improvement of claim 1 wherein the end wall of the pedestal is joined to the circumferential wall by a radius.

7. The improvement of claim 6 wherein the radius is at least 0.8 mm.

* * * * *